US005141396A

United States Patent [19]

Schmidt et al.

[11] Patent Number: 5,141,396

[45] Date of Patent: Aug. 25, 1992

[54] REGENERATING PUMP WITH GRAPHITE AND PLASTIC CASING AND IMPELLER

[75] Inventors: Christoph Schmidt, Alheim; Thomas Werner, Bad Hersfeld, both of Fed. Rep. of Germany

[73] Assignee: VDO Adolf Schindling AG, Frankfurt am Main, Fed. Rep. of Germany

[21] Appl. No.: 724,521

[22] Filed: Jun. 28, 1991

[30] Foreign Application Priority Data

Jul. 14, 1990 [DE] Fed. Rep. of Germany ..... 4022467

[51] Int. Cl.[5] ..... F01D 1/02

[52] U.S. Cl. ..... 415/200; 415/55,.1; 415/915; 416/241 A; 264/130; 264/299

[58] Field of Search ..... 415/55.1, 55.2, 55.3, 415/55.4, 55.5, 55.6, 55.7, 200, 915; 416/241 A; 417/DIG. 1; 264/130, 299, 319, 325

[56] References Cited

U.S. PATENT DOCUMENTS 2,905,093 9/1959 Raub et al. ..... 415/200
4,449,891 5/1984 Kemmner ..... 415/200
4,492,515 1/1985 Watanabe et al. .
4,834,400 5/1989 Lebeck ..... 277/DIG. 6
4,973,068 11/1990 Lebeck ..... 277/DIG. 6

FOREIGN PATENT DOCUMENTS 3130286 2/1983 Fed. Rep. of Germany .
3313950 10/1983 Fed. Rep. of Germany .
0266481 4/1989 Fed. Rep. of Germany .

*Primary Examiner*—Edward K. Look
*Assistant Examiner*—Christopher M. Verdier
*Attorney, Agent, or Firm*—Martin A. Farber

[57] ABSTRACT

A feed unit, in particular for the feed of fuel, has an electric drive motor with a pump unit coupled with it, the pump unit being built of two housing parts and a pump wheel arranged between them. The two housing parts and the pump wheel are each developed as a casting or compression molding from a mixture of graphite and plastic. The end surfaces of the pump wheel and of the two housing parts which contact each other are roughened.

5 Claims, 2 Drawing Sheets

REGENERATING PUMP WITH GRAPHITE AND PLASTIC CASING AND IMPELLER

FIELD AND BACKGROUND OF THE INVENTION

The present invention relates to a feed unit, in particular for the feeding of fuel, the feed unit having an electric drive motor and a pump unit coupled to it, the pump unit comprising a first housing part having a first annular sector-shaped feed channel which debouches into an axial inlet opening, and a second housing part having a second annular sector-shaped feed channel of the same diameter as the first one debouching into an axial outlet opening. The pump unit includes a central passage opening for the drive shaft of the drive motor. A pump wheel which is functionally connected to the drive shaft is arranged between the two housing parts and has a plurality of tooth-shaped blades which are arranged in the circumferential region of the wheel and cooperate with the sector-shaped feed channels.

Feed units of this type are already known in which the two housing parts and the pump wheel of the pump unit consist of aluminum. The parts are produced by the metal injection molding process and, subsequently, anodized or hard-coated which makes the parts very expensive. These known feed units are used in motor vehicles for the injection of gasoline, a nominal pressure on the order of 1.5 bar being required. With reference to the highest possible efficiency, this rated pressure can only be achieved if the axial gaps between pump wheel and housing parts are as small as possible. There are desired axial gaps of a total of 3/100 mm. For this reason, such pump units cannot be manufactured of thermoplasts or duroplasts because these plastics in combination with fuel tend to swell and therefore, after a few hours, block the swollen pump wheel between the housing parts. For the manufacture of these parts, therefore, aluminum which can be processed by injection molding has gained acceptance. However, as already mentioned, the follow-up work which is indispensable for this material is disadvantageous and greatly increases the costs.

The efficiency of the pump unit furthermore depends decisively on the course of the annular channels and their surface roughness. The smaller the latter, the higher the efficiency. By using aluminum, very slight surface roughnesses can be obtained so that the use of aluminum has up-to-now been retained also for this reason.

SUMMARY OF THE INVENTION

It is an object of the present invention to improve pumps of the type described above with respect to their efficiency and to furthermore develop them in such a manner that they can be manufactured at the least possible expense.

According to the invention, the two housing parts (1,2) and the pump wheel (3) of the pump unit are produced as casting or compression molding from a mixture of graphite and plastics, and the end surfaces of the pump wheel (3) and the two housing parts (1,2) which contact each other are roughened.

It has been found that parts made from a graphite-plastic mixture do not undergo any measurable swelling in fuel. Also their strength lies within useful limits. Therefore, they are suitable for the manufacture of components which come into contact with carburetor fuels.

Graphite-plastic mixtures consisting of 60 to 80 percent graphite with the remainder being phenolic resin have proven to be particularly advantageous in the practice of the invention.

Upon the production of components from graphite-plastic mixtures by casting or compression molding, very smooth surfaces are obtained, the depth of roughness of which is preferably around Rz 1 if the molds are suitably produced. Feed channels can thus be produced with a surface which is mirror-smooth or, stated differently, is of extremely slight roughness. The surfaces of the parts produced in this manner are so smooth that seizing of the pump wheel on the housing parts might occur upon the feeding of hot fuel. In order to prevent this, the end surfaces of the pump wheel and of the two housing parts which contact each other are roughened, namely, advantageously to a peak-to-valley height of between Rz 3 and Rz 20.

As a result of these mutually supportive and improving measures and features, there is thus created a pump unit which can then be manufactured not only at extremely low expense but also with very narrow tolerances, so that the high efficiency desired can also be achieved. It has been found that optimal efficiency is obtained when the peak-to-valley height to the roughened end surfaces of the pump wheel and for the housing parts is on the order of magnitude of Rz 10.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 2:
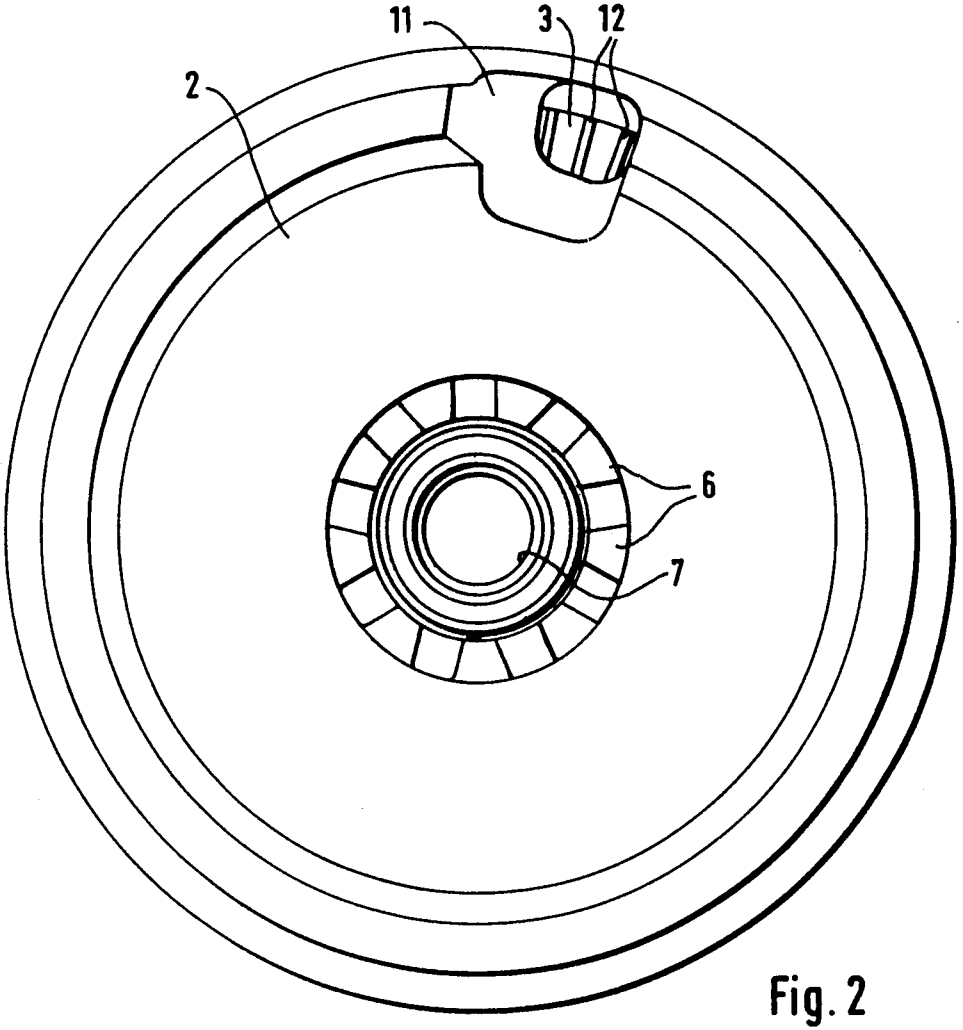
FIG. 2 is a top view on the pump unit of FIG. 1.

The pump unit consists of a first cover-like housing part 1, a second, cup-shaped housing part 2, and an impeller or a pump wheel 3 which is rotatably mounted in the cavity formed by the two housing parts 1 and 2. The rotatable mounting is effected by a bushing 4 which is formed on the pump wheel 3 and is radially guided in a corresponding recess 5 in the housing part 2. Axial teeth 6 are formed on the inner circumference of the bushing 4, the teeth 6 engaging into corresponding recesses 6A in a mating piece 6B seated on the drive shaft 4A of a drive motor 4B so that the drive shaft 4A and the pump wheel 3 are functionally connected to each other via this tooth-like coupling. The drive shaft 4A of the drive motor 4B is, furthermore, guided in a centrally arranged sleeve 7 of the housing part 1.

The housing part 1, furthermore, has a substantially axially extending inlet opening 8 which debouches into a feed channel 9 which extends in annular sector shape. The feed channel 9, together with a circular sector shaped feed channel 10 in the housing part 2, forms a hose-like feed space in which the fuel is conveyed from the inlet opening 8 by means of the impeller 3 to the outlet opening 11 formed in the housing part 2 which debouches into the feed channel 10.

Figure 1:
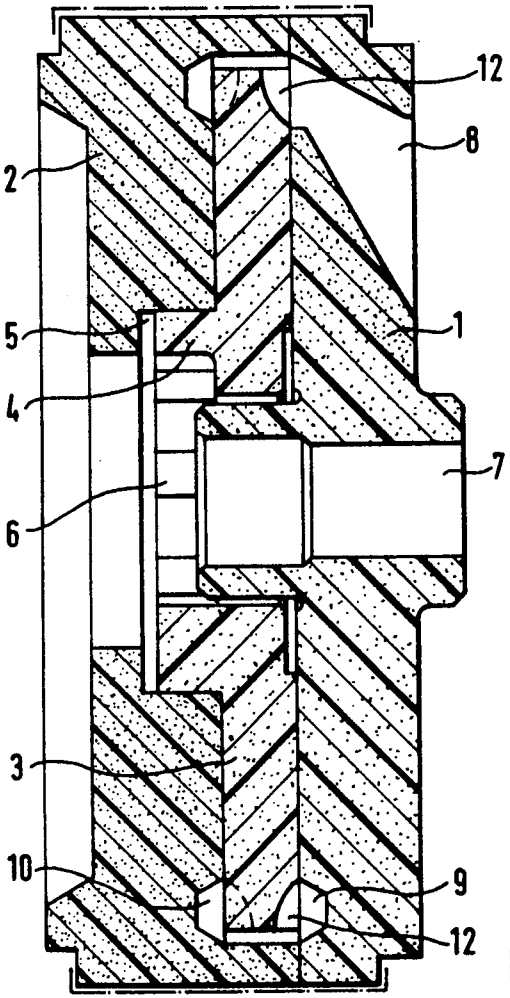
FIG. 1 is a cross section through a pump unit of the feed unit.
Figure 3:
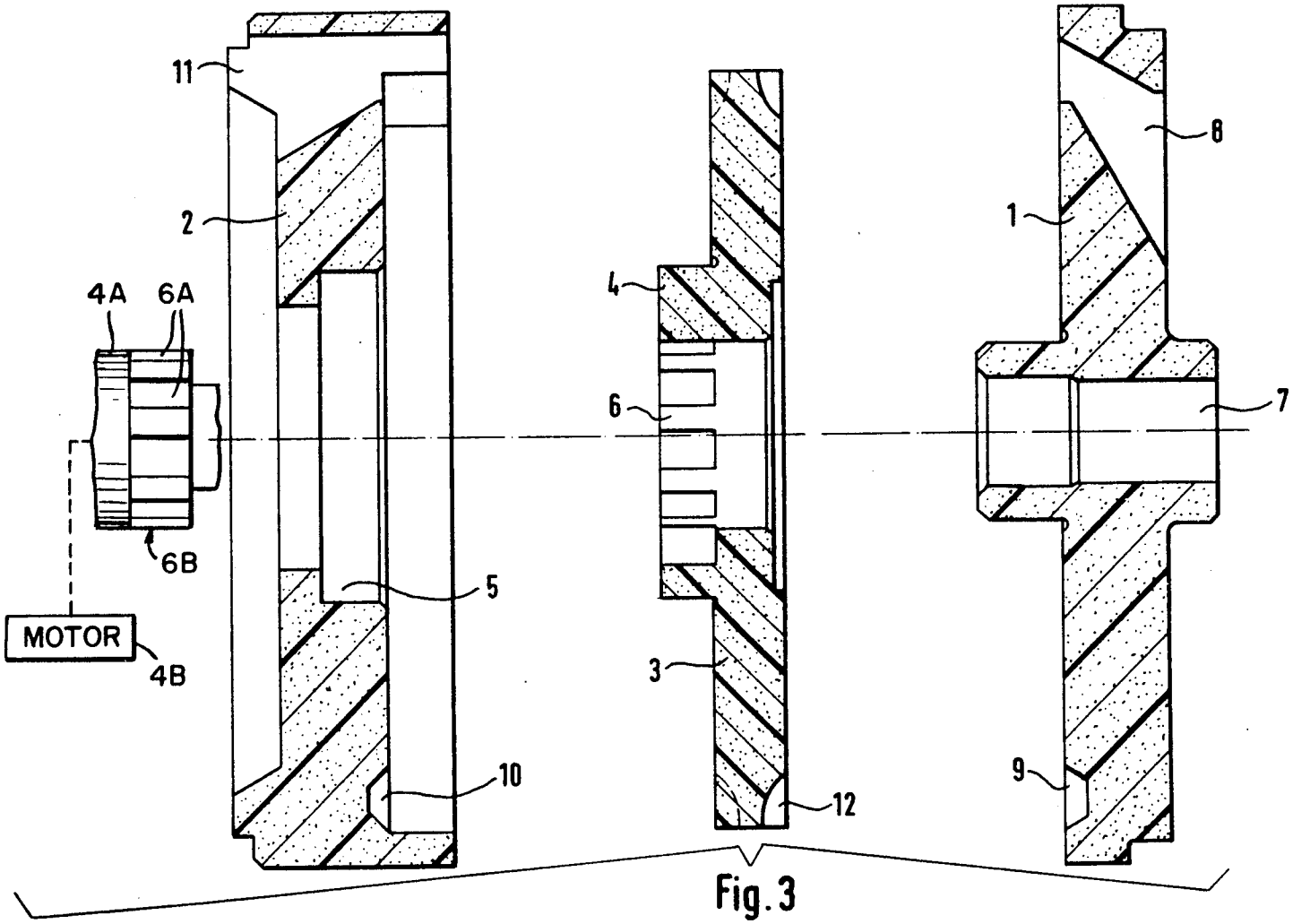
FIG. 3 is an exploded sectional view of the pump unit of FIG. 1.

As can be noted, in particular, from FIGS. 1 and 2, is the pump wheel 3 developed in the form of a gear with peripheral teeth, the wheel 3 being provided with a plurality of tooth-like blades 12 which are formed by axial recesses in the two-end regions of the pump wheel. The blades on the one end surface are staggered with respect to those on the other end surface by half the distance between two adjacent blades. Upon rotation of the pump wheel 3, there thus results a spirally advancing flow of fluid in the feed channels 9 and 10.

The smaller the depth of roughness of the wall surface of the delivery channels 9 and 10 and of the blades 12, the less friction occurs between these walls and the liquid spiral. Consequently, the peak-to-valley height of these walls enters directly into the pump output. The same applies by analogy to the air gap between the housing part 1 and the pump wheel 3 on the one side and the pump wheel 3 and the housing part 2 on the other side. The smaller these air gaps, the better the efficiency.

The housing parts 1 and 2 and the pump wheel 3 consists of artificial carbon - in accordance with a preferred embodiment, of a mixture of 60 to 80% graphite with the remainder being phenolic resin. After their production by injection molding or compression molding, they have a mirror-smooth surface which can have a peak-to-valley roughness of Rz 1 provided the injection molding tools are sufficiently precise. This small peak-to-valley height, which is excellently suited for the channels 9 and 10 and walls of the blades 12, would have the result that the pump wheel 3 might seize on the housing parts 1 and 2 when the three parts are under axial pressure. In order to prevent this, the end surfaces of the pump wheel 3 and the end surfaces of the housing parts 1 and 2 facing it are machined so that these surfaces have a peak-to-valley height of Rz 10. This roughening process destroys the outer-most layer of phenolic resin and exposes the graphite structure beneath it, which structure can now serve simultaneously as anti-seize agent and lubricant. This is a particular advantage of the pump unit of the invention.

Rz (a well known abbreviation in Germany) is the average value of peak-to-valley height of five separate peak-to-valley height values which are measured in five separate measuring distances $l_e$ succeeded one another.

$$R_z - 1_5(R_{z1} + R_{z2} + R_{z3} + R_{z4} + R_{z5})$$

$R_z$ is given in units of $\mu$m.

We claim:

1. A feed unit, suitable for feeding fuel, having an electric drive motor and a pump unit coupled to the drive motor, the pump unit comprising a first housing part having a first annular sector-shaped feed channel which debouches into an axial inlet opening;

a second housing part having a second annular sector-shaped feed channel of the same diameter as the first feed channel and debouching into an axial outlet opening;

a central passage opening for a drive shaft of the drive motor;

a pump wheel which is operatively connected to the drive shaft, the pump wheel being arranged between said first and said second housing parts and having a plurality of tooth-shaped blades which are arranged in a circumferential region and cooperate with the sector-shaped feed channels; and wherein said first and said second housing parts and said pump wheel are produced as casting or compression moldings, of a mixture of graphite and plastics; and end surfaces of said pump wheel and said first and said second housing parts which are located for contact with each other are roughened surfaces.

2. A feed unit according to claim 1, wherein a peak-to-valley height of the roughened surfaces is between Rz 3 and Rz 20.

3. A feed unit according to claim 2, wherein the peak-to-valley height is on the order of magnitude of Rz 10.

4. A feed unit according to claim 3, wherein a peak-to-valley height of non-roughened surfaces is on the order of magnitude of Rz 1.

5. A feed unit according to claim 4, wherein the mixture of graphite and plastic consist of 60 to 80 percent graphite and a remainder of phenolic resin.

* * * * *